US008092403B2

(12) United States Patent
Nan

(10) Patent No.: US 8,092,403 B2
(45) Date of Patent: Jan. 10, 2012

(54) VACUUM PRESSURE REGULATOR FOR HUMAN BODY TREATMENT DEVICES

(75) Inventor: Simon Siu Man Nan, Ontario (CA)

(73) Assignee: Nanma Manufacturing Co., Ltd., Hong Kong (HK)

( * ) Notice: Subject to any disclaimer, the term of this patent is extended or adjusted under 35 U.S.C. 154(b) by 1267 days.

(21) Appl. No.: 11/789,149

(22) Filed: Apr. 24, 2007

(65) Prior Publication Data

US 2008/0269650 A1 Oct. 30, 2008

(51) Int. Cl.
*A61H 7/00* (2006.01)

(52) U.S. Cl. ..... 601/7; 601/9; 600/38

(58) Field of Classification Search ..... 600/38, 600/40, 41; 601/6, 7, 8, 9, 10, 11, 14; 604/313, 604/319, 320; 137/494, 508, 907
See application file for complete search history.

(56) References Cited

U.S. PATENT DOCUMENTS 4,903,726 A * 2/1990 Martin et al. ..... 137/907
5,462,514 A * 10/1995 Harris ..... 601/11
5,682,624 A * 11/1997 Ciochetti ..... 137/907
6,464,653 B1 10/2002 Hovland et al.

* cited by examiner

*Primary Examiner* — Quang D Thanh
(74) *Attorney, Agent, or Firm* — Polsinelli Shughart PC

(57) ABSTRACT

One or more embodiments of the presently described invention provide a vacuum pressure regulator including a spring, a knob, a housing, a chamber and a diaphragm. The spring encircles the knob and is capable of being compressed when the knob is rotated in one direction. The chamber and diaphragm are located inside the housing. A seal is formed when the compression of the spring creates a spring force that pushes at least a part of the diaphragm against a sealing surface of the chamber. This seal enables the chamber to maintain or hold a vacuum pressure for more than a transitory time period.

6 Claims, 8 Drawing Sheets

VACUUM PRESSURE REGULATOR FOR HUMAN BODY TREATMENT DEVICES

BACKGROUND OF THE INVENTION

The presently described invention generally relates to vacuum pressure devices. More specifically, embodiments of the presently described technology provide an improved vacuum pressure regulator.

Pressure achieved through a vacuum is commonly used in human body treatment devices, such as the suction application in sexual aid devices for stimulating female genital regions. It is important for these devices to have controllable vacuum pressure levels. Ideally, these devices should have means for adjusting a vacuum pressure level.

Existing designs for providing adjustable vacuum pressure level device in the art suffer from several shortcomings. For example, existing devices suffer from high energy loss during use of the device. In addition, several devices are frequently unable to maintain a consistent controlled pressure level. That is, the pressure level in the devices varies greatly.

Another method for controlling the vacuum pressure includes using a spring loaded pressure release mechanism. Such a mechanism is disposed in the vacuum environment to adjust the vacuum pressure. However, providing such a mechanism inside the vacuum chamber or environment introduces considerable complexity of manufacture and therefore, an increase in cost.

Thus, a need exists for a reliable pressure regulating mechanism that can provide a more consistent level of controlled pressure, lower energy consumption and/or decreased manufacturing cost.

BRIEF SUMMARY OF THE INVENTION

One or more embodiments of the presently described invention provide a vacuum pressure regulator including a spring, a knob, a housing, a chamber and a diaphragm. The spring encircles the knob and is capable of being compressed when the knob is rotated in one direction. The chamber and diaphragm are located inside the housing. A seal is formed when the compression of the spring creates a spring force that pushes at least a part of the diaphragm against a sealing surface of the chamber. This seal enables the chamber to maintain or hold a vacuum pressure for more than a transitory time period.

One or more embodiments of the presently described invention provide a method for regulating a vacuum pressure in a device. The method includes generating a spring force towards a distal end of the device, pushing at least a portion of a diaphragm against a sealing surface of an internal chamber of the device using the spring force, pulling at least the portion of the diaphragm towards a proximal end of the device using a vacuum pressure in the internal chamber, and maintaining the vacuum pressure in the internal chamber so long as the spring force is greater than the vacuum pressure.

One or more embodiments of the presently described invention also provide a vacuum pressure regulator device including a housing, a tube, a spring, an end cover and a valve dish. The housing includes a first chamber that has internal screw threads. The tube includes a flange portion that has external screw threads. These external screw threads are configured to engage with the internal screw threads of the first chamber. The spring is located between the flange portion and a washer. The end cover includes a second chamber. The valve dish is made of a resilient material. Rotation of the tube in one direction causes the tube and the flange portion to move towards the end cover. This movement also compresses the spring between the flange portion and washer. By compressing the spring, a spring force is created that pushes the valve dish against a sealing surface of the second chamber to form a seal in this chamber that is capable of maintaining a vacuum pressure.

Figure 1:
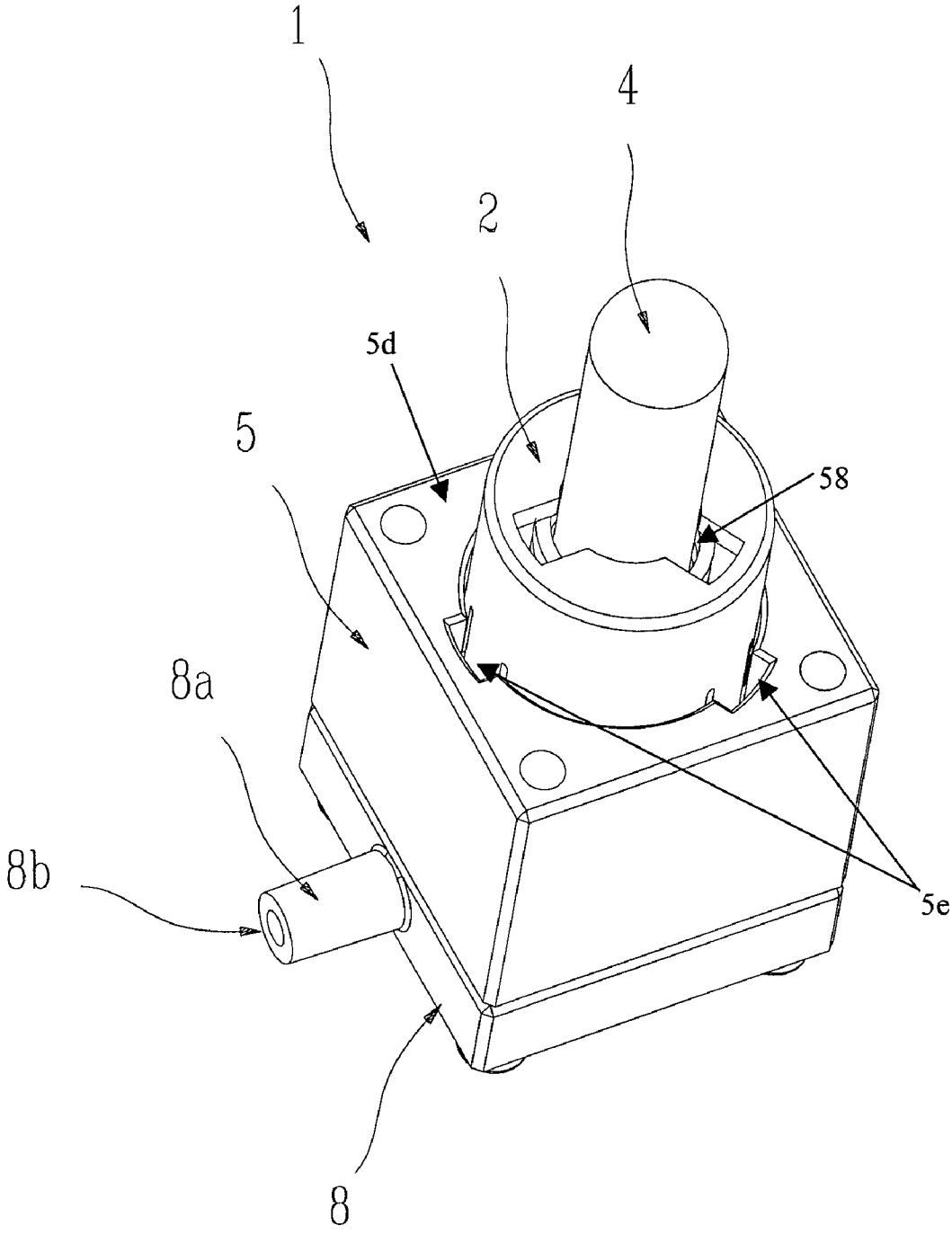
FIG. 1 illustrates a perspective view of a vacuum pressure regulator in accordance with an embodiment of the presently described invention.

The foregoing summary, as well as the following detailed description of certain embodiments of the presently described technology, will be better understood when read in conjunction with the appended drawings. For the purpose of illustrating the presently described technology, certain embodiments are shown in the drawings. It should be understood, however, that the presently described technology is not limited to the arrangements and instrumentality shown in the attached drawings.

DETAILED DESCRIPTION OF THE INVENTION

In accordance with one or more embodiments of the presently described technology, an improved vacuum pressure regulator device or mechanism is provided. The device can be manually operated to more efficiently control a vacuum level (or pressure) in another device. In an embodiment, the device in which the vacuum level is controlled is a sexual assistance device. Such a device can provide suction or suction and pulsed stimulation to the genital region of a female.

In an embodiment of the presently described invention, a vacuum pressure regulator can set the vacuum pressure at various levels from a minimum value (for example, 0) to a maximum value by turning a knob.

In an embodiment of the presently described invention, a vacuum pressure regulator can maintain a vacuum pressure more consistently than existing devices or regulators at a set or desired pressure level.

In an embodiment of the presently described invention, a vacuum pressure regulator can operate with less energy loss in the vacuum generating process than existing devices. That is, embodiments of the invention can create a vacuum at one or more of a variety of pressure levels while using less energy than existing devices.

In an embodiment, the disclosed vacuum pressure regulator is small enough to be held by a single human hand. That is, the regulator can be hand-held.

Figure 2:
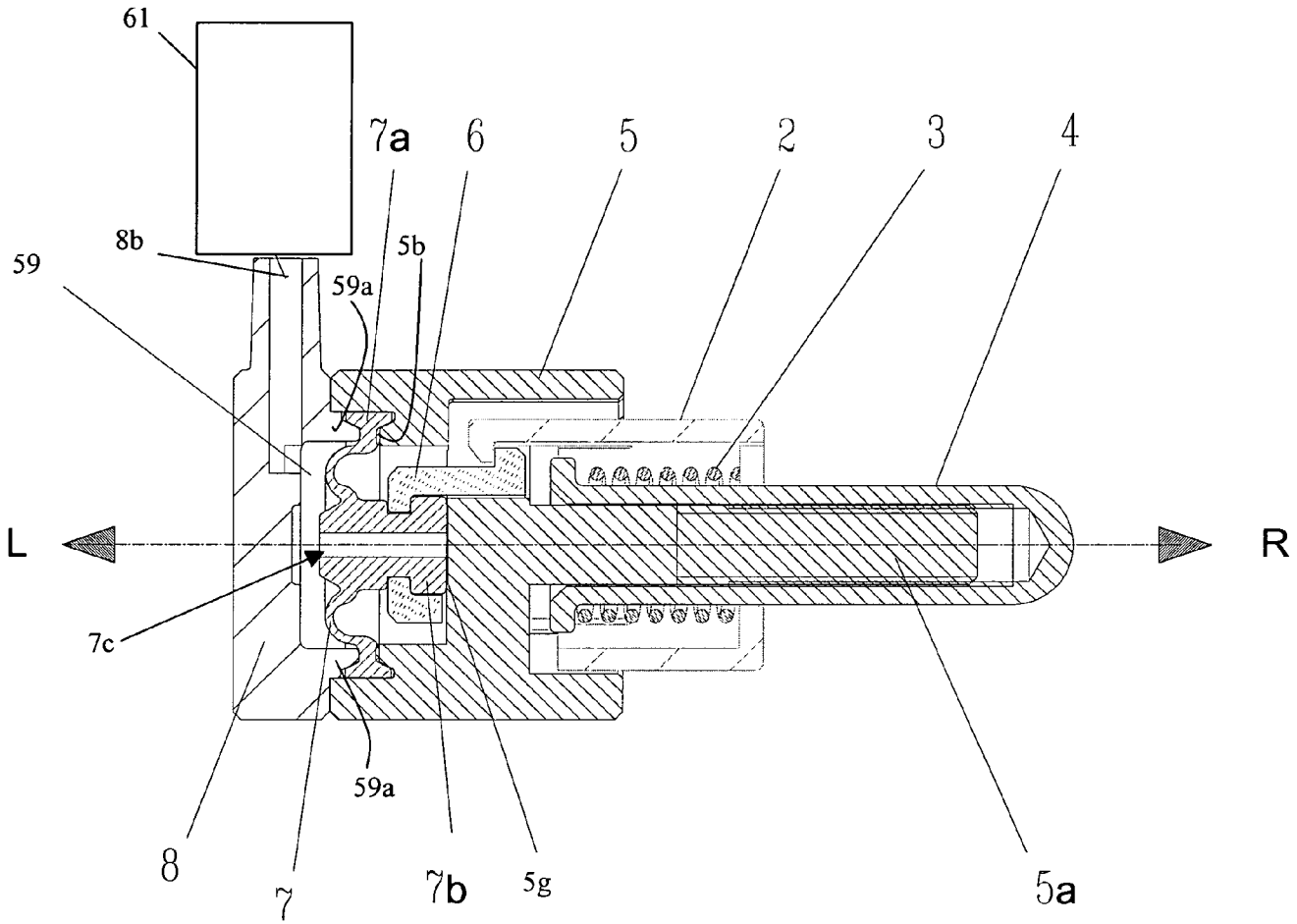
FIG. 2 illustrates a cross-sectional view of the vacuum pressure regulator in accordance with an embodiment of the presently described invention.

FIG. 1 illustrates a perspective view of a vacuum pressure regulator 1 in accordance with an embodiment of the presently described invention. FIG. 2 illustrates a cross-sectional view of vacuum pressure regulator 1 in accordance with an embodiment of the presently described invention. Vacuum pressure regulator 1 comprises a pulling tube 2, a spring 3, a turning tube or knob 4, a main housing 5, a diaphragm coupling 6, a diaphragm 7 and an end cover 8. End cover 8 includes a tube connector 8*a*. In an embodiment, spring 3 is a compression spring.

Figure 3:
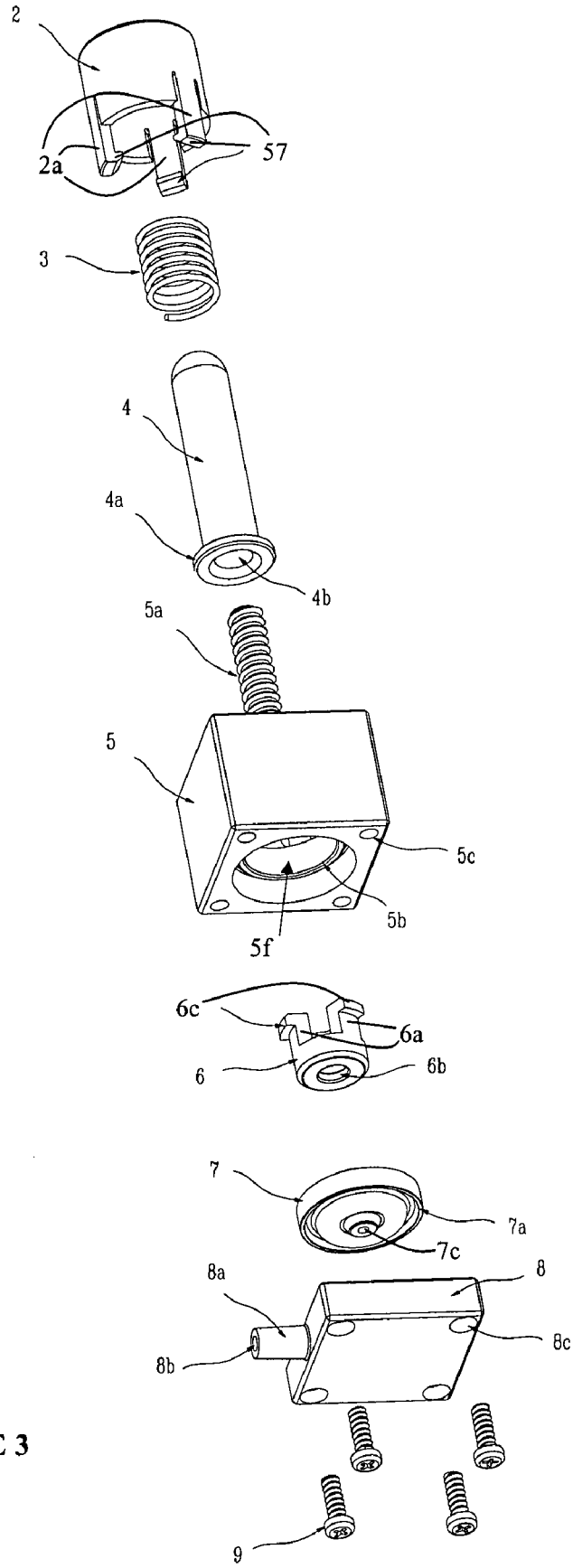
FIG. 3 illustrates an exploded view of the vacuum pressure regulator in accordance with an embodiment of the presently described invention.

FIG. 3 illustrates an exploded view of vacuum pressure regulator 1 in accordance with an embodiment of the presently described invention. As shown in FIG. 3, pulling tube 2 can be in a hollow cylindrical shape. One or more hooks 2*a* can be provided on tube 2. For example, as shown in FIG. 3, three inner hooks 2*a* can be evenly distributed along a circumference of a proximal end of tube 2.

In an embodiment, tube 2 includes a through hole 58 that extends through a distal end of tube 2, as shown in FIGS. 1 and 2. Hole 58 in the distal end of tube 2 can be smaller in diameter than the opening defined by the circumference upon which hooks 2*a* are connected.

In an embodiment, each of hooks 2*a* includes an inwardly protruded portion or hook end 57. Spring 3 can be disposed inside pulling tube 2 from the proximal end of tube 2. Spring 3 can then be placed over turning tube or knob 4 (or, turning knob 4 can be inserted into spring 3) from its distal end such that the distal end of knob 4 passes through hole 58 of pulling tube 2. That is, spring 3 is placed so that it encircles at least a portion of knob 4.

A flange portion 4*a* is located at the proximal end of turning tube or knob 4. In an embodiment, turning knob is hollow with a closed distal end and an open proximal end. That is, knob 4 includes an opening 4*b* at its proximal end. The internal surface of knob 4 can include an internal screw thread. This screw thread is adapted to engage and turn onto an external screw thread of a post 5*a*.

Post 5*a* is a protrusion extending from a partition inside main housing 5. In an embodiment, post 5*a* is built on a face of a partition wall 5*d* on the distal end of main housing 5.

In an embodiment, one or more slots 5*e* are provided on partition wall 5*d* of main housing 5. These slots 5*e* correspond to positions of inner hooks 2*a* such that slots 5*e* will provide inner hooks 2*a* with enough clearance for hooks 2*a* to move slightly outward when hooks 2*a* engage with outer hooks 6*a* by snapping over hooks 6*a*.

A circular chamber or opening 5*f* exists on the proximal end of main housing 5. Chamber 5*f* includes an outwardly protruded circular rim 5*b*.

Housing 5 also includes one or more through holes 5*c* disposed at one or more corners of main housing 5.

A diaphragm coupling 6 includes one or more outer hooks 6*a*. Coupling 6 includes a center hole 6*b* at its proximal end. In an embodiment, a plurality of outer hooks 6*a* are distributed evenly along the circumference of the coupling 6. At an end of each outer hook 6*a* there is a radially protruded portion 6*c* forming a hook tip.

A diaphragm 7 is also provided. Diaphragm 7 is preferably made of a resilient material. For example, diaphragm 7 can be made of a resilient material such as silicone or rubber. Diaphragm 7 includes a circumference rim 7*a* and a center hole 7*c*. At one side of the diaphragm 7 there is a center circular boss 7*b* (as shown in FIG. 2). Boss 7*b* can be inserted or forced into center hole 6*b* of diaphragm coupling 6 to form a valve gate assembly, as shown by the combination of boss 7*b* and coupling 6 in FIG. 2.

An end cover 8 has a circular vacuum chamber 59 at the distal end of cover 8. End cover 8 also includes one or more through holes 8*c*. At an opening of chamber 59 is an outwardly protruded circular rim 59*a*. In an embodiment, rim 59*a* is approximately the same size as rim 5*b*. For example, rim 59*a* can have a diameter that is within manufacturing tolerances standard in the industry as being the same or identical size as rim 5*b*.

A tube connector 8*a* is located outside end cover 8 and on one of side walls of cover 8. Tube connector 8*a* includes a center hole 8*b*. Hole 8*b* permits communication from the outside of tube connector 8*a* and vacuum chamber 59. In an embodiment, tube connector 8*a* is capable of being inserted into or otherwise connected with a vacuum pump 61 or other device 61 capable of creating a vacuum pressure in chamber 59. By connecting vacuum pump 61 with device 1 via tube connector 8*a*, vacuum pump 61 is placed into fluid communication with chamber 59. That is, a fluid is capable of passing from chamber 59 to pump 61. Vacuum pump 61 is shown schematically in FIG. 2.

Outer hooks 6*a* and inner hooks 2*a* are arranged to engage with one another. For example, after diaphragm coupling 6 is incorporated with diaphragm 7, hooks 6*a* and/or coupling 6 and diaphragm 7 can be pushed from the proximal end of main housing 5 and across slots 5*e* in housing 5 while, after inner hooks 2*a* of tube 2 are incorporated with spring 3 and turning knob 4 disposed from the distal end of housing 5, outer hooks 6*a* and inner hooks 2*a* are engaged with one another by snapping onto each other. Once outer hooks 6*a* and inner hooks 2*a* are engaged with one another, the components of regulator 1 discussed above are retained in housing 5.

End cover 8 can then be attached or fastened to main housing 5. By fastening end cover 8 to housing 5, diaphragm 7 can be clamped down at its outer rum 7*a* in such a way as to seal the areas of contact between housing 5 and end cover 8 (as shown in FIG. 2). In an embodiment, screws 9 can be used to fasten end cover 8 to main housing 5.

In operation, a vacuum pump or other device capable of generating a vacuum pressure in chamber 59 is connected to regulator 1. As described above, a vacuum pump can be connected to regulator 1 via tube connector 8*a*.

A user rotates knob 4 around its longitudinal axis so that it moves along post 5*a*. In an embodiment, rotating knob 4 in a clockwise direction moves knob 4 in the direction L as shown in FIG. 2 (or, towards the proximal end of device 1) and rotating knob 4 in a counter-clockwise direction moves knob 4 in the direction R as shown in FIG. 2 (or, towards the distal end of device 1).

In another embodiment, rotating knob 4 in a counter-clockwise direction moves knob 4 in the direction L as shown in FIG. 2 and rotating knob 4 in a clockwise direction moves knob 4 in the direction R as shown in FIG. 2.

Causing knob 4 to move in the direction R can cause spring 3 to be compressed. When spring 3 becomes compressed, spring 3 drives tube 2 and, in turn, coupling 6 in the direction R. As coupling 6 is driven in the direction R by the spring force along direction R, diaphragm 7 and/or circular boss 7*b* is pressed against a sealing surface 5*g* of housing 5. As diaphragm 7 and/or circular boss 7*b* presses against sealing surface 5*g*, chamber 59 becomes sealed and a vacuum environment then can be established in chamber 59 using a vacuum pump 61 connected to regulator 1.

Once a vacuum environment is established in chamber 59 using a vacuum pump 61 connected to regulator 1, as described above, a vacuum force tending to pull diaphragm 7 and/or circular boss 7*b* in the direction indicated by L is produced. This vacuum force can tend to pull diaphragm 7 and/or boss 7*b* away from sealing surface 5*g*. When the vacuum pressure is developed to a sufficient level such that the vacuum force along direction L pulling diaphragm 7 and/or boss 7*b* away from sealing surface 5*g* is larger than the spring force along direction R, the seal formed by diaphragm 7 and/or boss 7*b* becomes interrupted, compromised or destroyed. By "destroyed" it is meant that the seal is interrupted or otherwise changed so as to be unable to maintain the vacuum pressure in chamber 59.

A leak can be created at sealing surface 5*g* when the seal is interrupted, compromised or destroyed. This leak is an air leak. Air leaks in to vacuum chamber 59 and releases the vacuum pressure in chamber 59, consequently lowering the vacuum force along direction L. Air continues to leak in to chamber 59 and lower the vacuum force along direction L until the vacuum force is approximately equal to or less than the spring force along direction R. In an embodiment, the vacuum force along direction L lowers until a seal is once again formed against sealing surface 5*g*.

A vacuum pressure therefore can be maintained at a variety of levels or pressures by adjusting the compression of spring 3 (and the spring force along direction R). By "maintained," it is meant that an air pressure that is less than atmospheric air pressure can exist in chamber 59 for more than a transitory time period. By turning knob 4 around to one or more positions, the compression in spring 3 varies or changes. As the amount of compression of spring 3 varies or changes, the corresponding vacuum force along direction L is adjusted as described above. In doing so, the amount, level or pressure of the vacuum pressure can be adjusted and controlled by a user using device 1.

Figure 4:
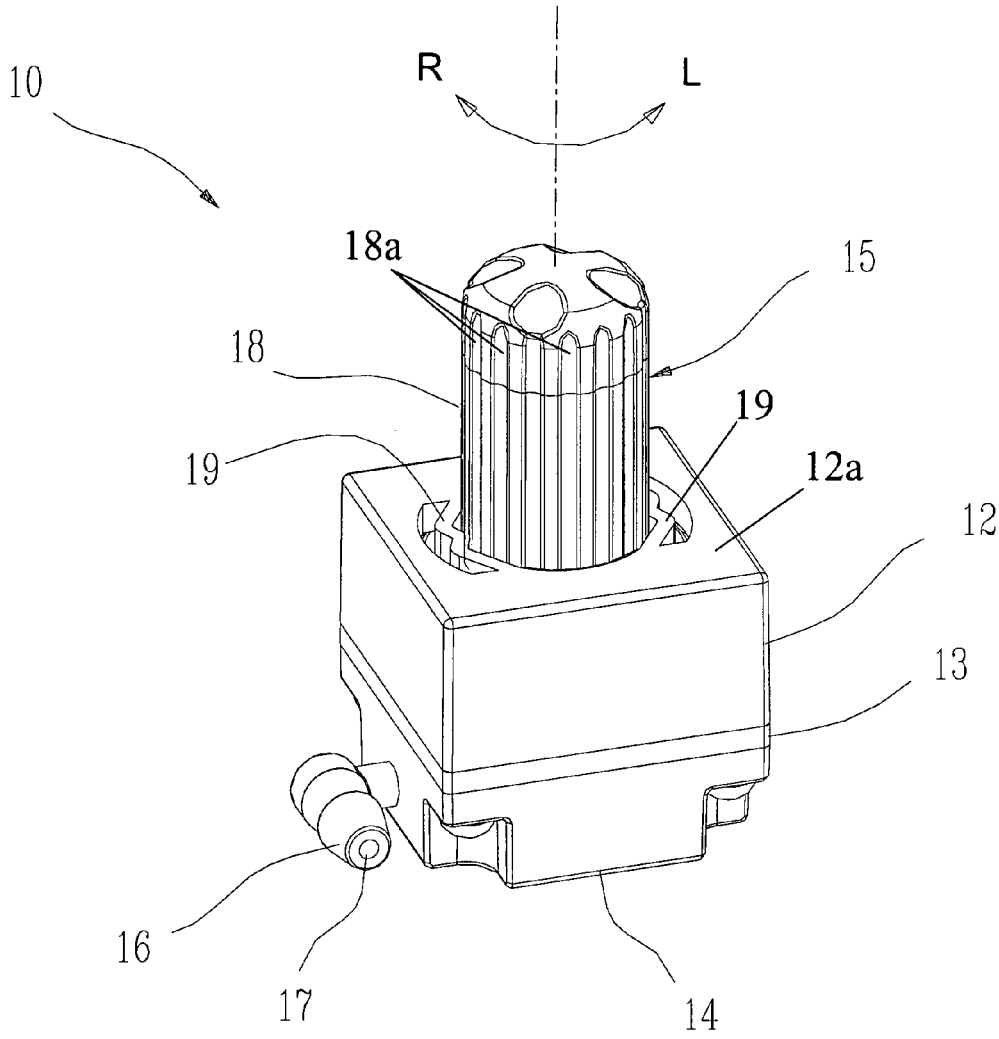
FIG. 4 illustrates a perspective view of a vacuum pressure regulator in accordance with another embodiment of the presently described invention.

FIGS. 4-7 illustrate views of another embodiment of the pressure regulating device described herein. FIG. 4 illustrates a perspective view of a vacuum pressure regulator 10 in accordance with another embodiment of the presently described invention. Regulator 10 includes a main housing 12, an intermediate block 13, an end cover 14, a turning knob assembly 15, a tube connector 16 with an air nozzle 17, a cylindrical tube 18, and one or more ratchets 19 on a top face 12*a* of main housing 12. Each of ratchets 19 can include a certain elasticity or give. That is, each of ratchets 19 can flex, or give, in response to an outside tensile force. Each of ratchets 19 is engaged with one or more slots 18*a* on an outer surface of cylindrical tube 18. The engagement with one or more of ratchets 19 with one or more slots 18*a* can provide a restriction to the free rotation of tube 18. That is, ratchet(s) 19 and slots 18*a* can interact with one another to impede rotation of tube 18.

Figure 5:
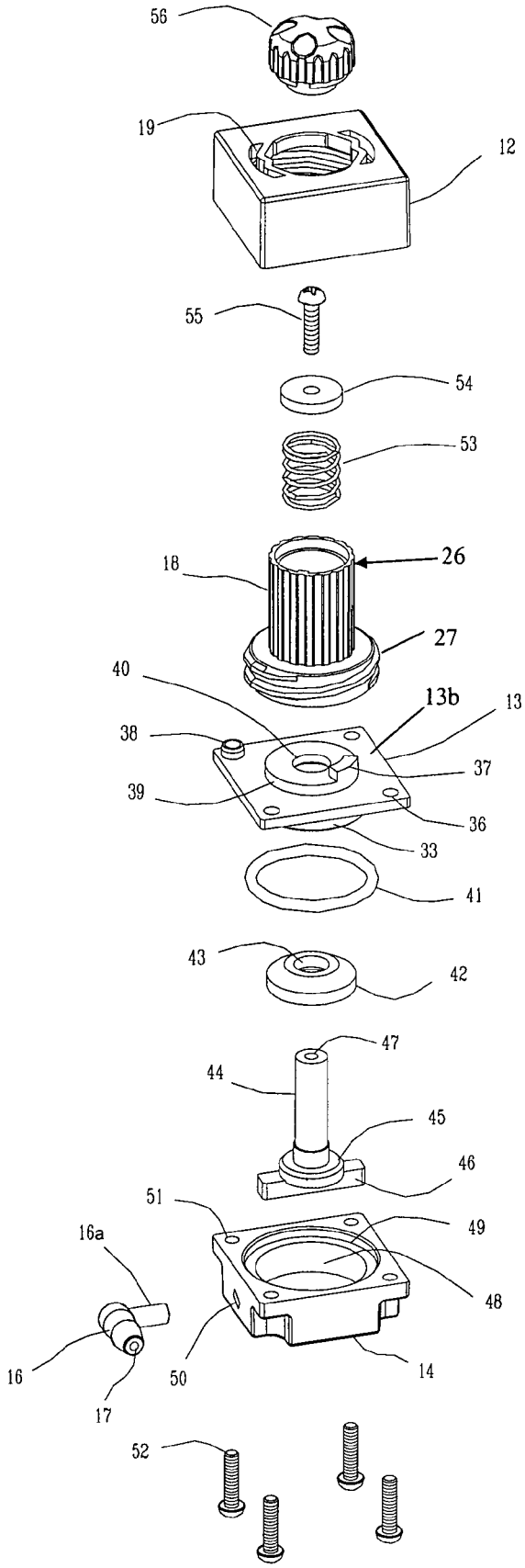
FIG. 5 illustrates an exploded view of the regulator device in accordance with another embodiment shown in FIG. 4 of the presently described invention.
Figure 6:
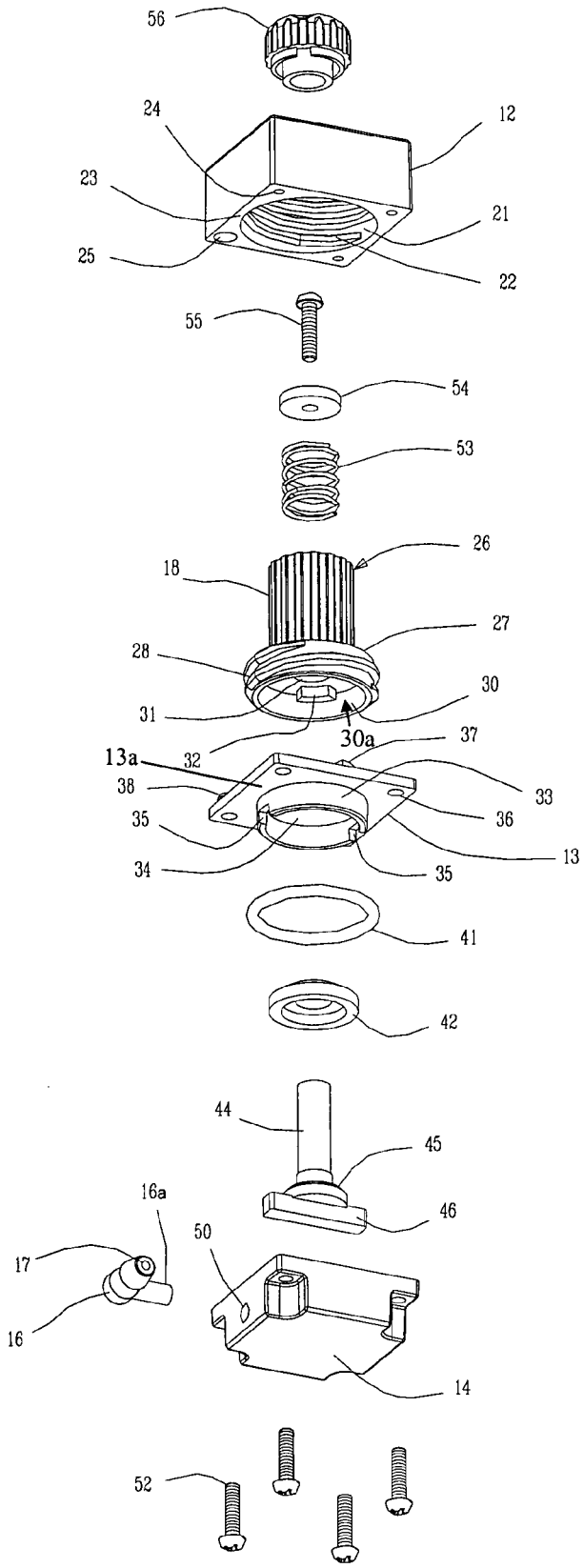
FIG. 6 illustrates a second exploded view of the regulator device in accordance with another embodiment shown in FIG. 4 of the presently described invention.
Figure 7:
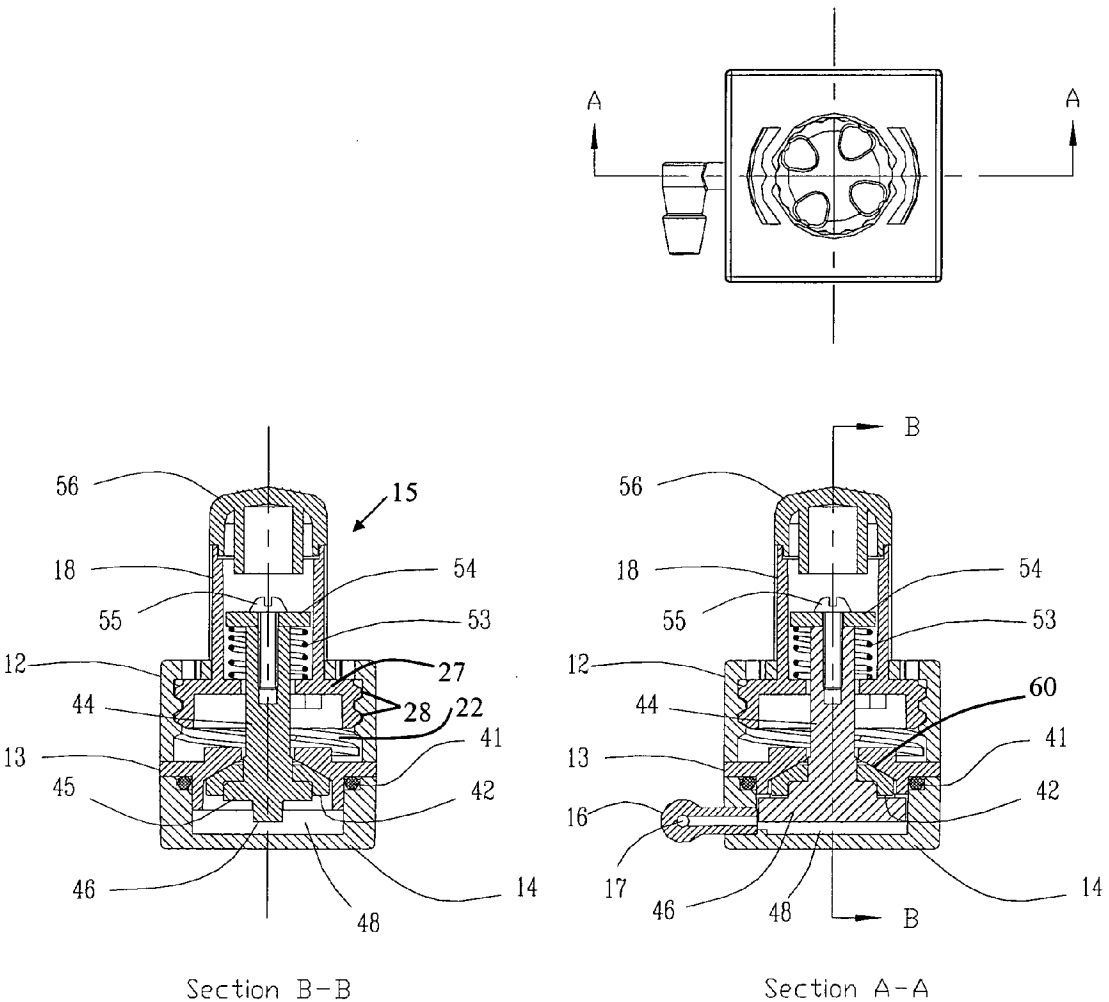
FIG. 7 illustrates cross-sectional views of the regulator device in accordance with another embodiment shown in FIG. 4 of the presently described invention.

FIG. 5 illustrates an exploded view of regulator device 10 in accordance with an embodiment of the presently described invention. FIG. 6 illustrates a second exploded view of regulator device 10 in accordance with an embodiment of the presently described invention. FIG. 7 illustrates cross-sectional views of regulator device 10 in accordance with an embodiment of the presently described invention.

Referring to FIGS. 5-7, main housing 12 includes a chamber 21 (as shown in FIG. 6) with an opening at lower face 23. Chamber 21 also includes internal screw threads 22. Screw threads 22 can include multiple threads that provide a larger lead of the screw threads 22.

A lower face 23 of housing 12 includes one or more screw holes 24 that each includes a screw thread. Lower face 23 also includes a locating hole 25.

Top face 12*a* of main housing 12 includes one or more ratchets 19 (as shown in FIG. 5, for example). A knob casing 26 includes a cylindrical tube 18 with a plurality of slots 18*a* on an outer surface of tube 18.

A flange portion 27 of tube 18 includes external screw threads 28. In an embodiment, these external screw threads 28 preferably include multiple threads. External screw threads 28 are designed to engage with internal screw threads 22.

Tube 18 includes a chamber 30 with an opening 30*a* (defined by flange portion 27), a center hole 31 and a moving stopper device 32 located inside chamber 30.

An intermediate block 13 includes a circular portion 33 at its lower face 13*a* that defines a chamber 34 having an opening, two notches 35 on an edge of chamber 34 opening and one or more mounting holes 36.

An upper face 13*b* of intermediate block 13 includes a locating peg 38 for engagement with locating hole 25 in main housing 12, as shown in FIG. 5. Face 13*b* of block 13 includes a circular portion 39 having a stopping block 37, and a center hole 40.

End cover 14 includes a chamber 48 defining an opening, a circular slot 49 on an edge of chamber 48 opening, a hole 50 in communication with interior of chamber 48, and one or more mounting holes 51.

A tube connector 16 includes a cylindrical portion 16*a*. This cylindrical portion 16*a* includes a center hole that provides communication with a nozzle 17. Tube connector 16 is affixed onto hole 50 of end cover 14. In an embodiment, tube connector 16 is capable of being inserted into or otherwise connected with a vacuum pump or other device capable of creating a vacuum pressure in chamber 48.

A sealing element 41 such as an O-ring made of resilient material is disposed in a slot 49 of cover 14. A valve dish 42 includes a center hole 43 and is put on a valve pin 44. In an embodiment, valve dish 42 can be made of a resilient material. For example, valve dish 42 can be made of silicone or rubber. Valve pin 44 can be fabricated in an elongated form or shape. Valve pin 44 includes a flange 45 at its lower end. A cross bar 46 is built on to flange 45. In an embodiment, cross bar 46 is fixed on flange 45 and is not removable without damaging flange. A center hole 47 is located on a top end of pin 44 for accepting screw 55. Screw 55 connects washer 54 with tube 44.

Once turning knob assembly 15 is assembled, knob casing 26 can engage with main housing 12. That is, knob casing 26 can engage its screw threads 27 to screw threads 22 on main housing 12. Knob casing 26 can rotate about a center axis of tube 18 relative to main housing 12.

Stopping block 37 can limit an angular movement or displacement of moving stopper device 32. Valve pin 44 carrying valve dish 42 is inserted from a lower end of block 13 and is passed through center hole 40. Pin 44 is inserted until eventually cross bar 46 is located in notches 35. Sealing element 41 is placed on circular portion 33. A spring 53 and washer 54 are placed from a top end of knob casing 26 into the chamber defined by tube 18. A screw 55 is then fastened into center hole 47 in pin 44 to retain spring 53 and washer 54 on pin 44. A knob cap 56 is connected or affixed on top of tube 18. Main housing 12, intermediate block 13 with turning knob assembly 15 and end cover 14 can clamped together by fastening a set of screws 52 through mounting holes 51 and 36 into holes 24.

In operation, a vacuum pump or other device capable of generating a vacuum pressure in chamber 48 is connected to regulator 10. As described above, a vacuum pump can be connected to regulator 10 via tube connector 16. That is, a pump can be connected in a manner similar to connecting pump 61 to device 1.

A user rotates knob assembly 15 relative to housing 12. Rotation of knob assembly 15 causes tube 18, flange portion 27 of tube 18 and external screw threads 28 of flange portion 27 to also rotate. Depending on the orientation of internal screw threads 22 and external screw threads 28, rotating assembly 15 in one direction causes assembly 15, tube 18 and flange portion 27 to move away from end cover 14 and towards a distal end of device 10 while rotating assembly 15 in the other direction causes these elements to move towards end cover 14 and towards a proximal end of device 10.

As assembly 15, tube 18 and flange portion 27 move away from end cover 14, spring 53 becomes compressed between washer 54 and flange portion 27. Conversely, as assembly 15, tube 18 and flange portion 27 move towards end cover 14, spring 53 can become less compressed between washer 54 and flange portion 27.

As spring 53 is compressed, cross bar 46 and valve dish 42 become pressed against a sealing surface 60 that is the contact surface between valve dish 42 and intermediate block 13. Once a vacuum pressure is generated in chamber 48 by a vacuum pump, as described above, the force of valve dish 42 and cross bar 46 against sealing surface 60 creates a seal that maintains the vacuum pressure in chamber 48. Conversely, as the force of valve dish 42 and cross bar 46 against sealing surface 60 decreases, the seal around chamber 48 can become interrupted, compromised or destroyed and air can leak into chamber 48, thus decreasing the vacuum pressure in chamber 48. By "destroyed" it is meant that the seal is interrupted or otherwise changed so as to be unable to maintain the vacuum pressure in chamber 48.

That is, similar to the previously described embodiment, once a vacuum environment is established in chamber 48, a vacuum force tending to pull valve dish 42 and cross bar 46 towards end cover 14 is produced. This vacuum force can tend to pull valve dish 42 away from sealing surface 60. When the vacuum pressure is developed to a sufficient level such that the vacuum force that pulls valve dish 42 away from sealing surface 60 is larger than the spring force generated by spring 53 that pushes valve dish 42 towards sealing surface 60, a leak can be created at sealing surface 60. This leak is an air leak. Air leaks in to chamber 48 and releases the vacuum pressure in chamber 48 and thereby lowers the vacuum force. Air continues to leak in to chamber 48 and consequently lower the vacuum force that pulls valve dish 42 towards end cover 14 until the vacuum force is approximately equal to or less than the spring force in a direction away from end cover 14. In an embodiment, the vacuum force pulling valve dish 42 towards end cover 14 lowers until a seal is once again formed against sealing surface 60.

A vacuum pressure therefore can be maintained at a variety of levels or pressures by adjusting the compression of spring 53 (and the spring force away from end cover 14). By turning knob assembly 15 around to one or more positions, the compression in spring 53 varies. As the amount of compression of spring 53 varies, the corresponding vacuum force that tends to pull valve dish 42 towards end cover 14 is adjusted as described above. In doing so, the amount, level or pressure of the vacuum generated by the device can be adjusted and controlled by a user.

Figure 8:
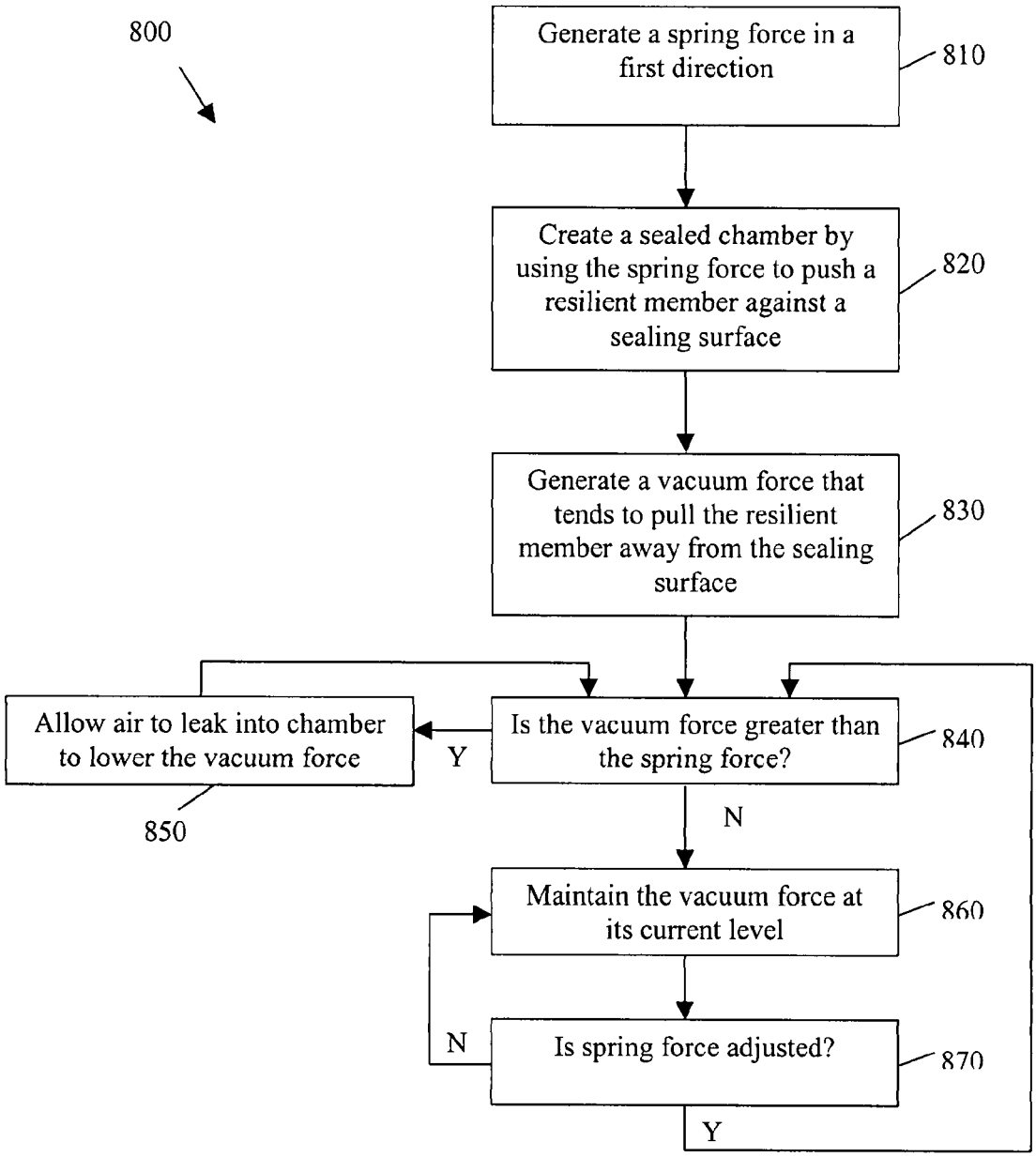
FIG. 8 illustrates a flowchart of a method for controlling a vacuum pressure using a vacuum pressure regulator in accordance with an embodiment of the presently described invention.

FIG. 8 illustrates a flowchart of a method 800 for controlling a vacuum pressure using a vacuum pressure regulator in accordance with an embodiment of the presently described invention. First, at step 810, a spring force is generated in a first direction. For example, as described above, a spring 3 can be compressed by rotating a knob 4. In another example, a spring 53 can be compressed by rotating a knob assembly 15. In either example, the compression of spring 3, 53 creates a spring force in a direction such as direction L of FIG. 2 or in the direction of knob assembly 15 in FIG. 7, for example.

Next, at step 820, a sealed chamber is created by using the spring force generated in step 810 to push a resilient member against a sealing surface. For example, compression of spring 3 causes tube 2 and coupling 6 to be pushed in direction R. As tube 2 and coupling 6 are pushed, a diaphragm 7 and/or circular boss 7*b* is pressed against a sealing surface 5*g*, as described above. In another example, compression of spring 53 causes a cross bar 46 and valve dish 42 (made of a resilient material) to be pressed against sealing surface 60, also as described above. As diaphragm 7 and/or circular boss 7*b* and valve dish 42 are pressed by a spring force against their respective sealing surfaces 5*g* and 60, a seal can be formed for chambers 59 and 48, as described above.

Next, at step 830, a vacuum force is generated that tends to pull the resilient member away from its sealing surface. For example, as described above, a vacuum pump can be placed in communication with chambers 59 and 48 as described above and shown in the Figures using tube connectors 8*a* and 16. This pump can generate a vacuum environment in chambers 59 and 48. This vacuum environment creates a vacuum force that tends to pull resilient members 7, 7*b* and/or 42 away from their respective sealing surfaces 5*g* and 60.

Next, at step 840, method 800 proceeds based on whether the vacuum force that tends to pull the resilient member away from its sealing surface is greater than the spring force that tends to push the resilient member towards its sealing surface. For example, if the vacuum force is greater than the spring force, method 800 proceeds from step 840 to step 850. On the other hand, if the vacuum force is equal to or less than the spring force, method 800 proceeds from step 840 to step 860. As described above, a seal around chamber 59, 48 is created at step 820. This seal is maintained by the spring force generated at step 810. If the vacuum force generated at step 830 overcomes this spring force, then the seal around chamber 59, 48 can become compromised and permit air to leak into chamber 59, 48. Thus, for example, if air is permitted to leak into chamber 59, 48, method 800 proceeds from step 840 to step 850.

At step 850, air is permitted to leak into the chamber and thus lower the vacuum pressure (and vacuum force), as described above. After step 850, method 800 proceeds back to step 840.

If the vacuum force is not greater than the spring force, then method 800 proceeds from step 840 to step 860. In other words, if the vacuum force is not sufficient to overcome the spring force, the seal around chamber 59, 48 is restored or maintained and the vacuum environment is maintained. In this manner, method 800 can proceed in a loop among steps 840, 850 and 860 where unequal vacuum and spring forces are adjusted until they reach an equilibrium state. Or, as the vacuum pressure is lowered at step 850 to a point where the spring force is equal to or greater than the vacuum force, the seal around the chamber is restored.

Following step 860, method 800 proceeds based on whether the spring force is increased or decreased. If the spring force is adjusted (that is, increased or decreased), method 800 proceeds from step 860 to step 870. If the spring force is not adjusted, method 800 returns back to step 860 from step 870. For example, the amount of compression in spring 3 or 53 can be changed, as described above. As the spring force is adjusted, the vacuum force required to overcome the seal around the chamber must also be adjusted. That is, if the spring force is increased, a larger vacuum force is required to overcome the seal around the chamber. Alternatively, if the spring force is decreased, a smaller vacuum force is required to achieve the same result. In this manner, method 800 proceeds in a loop among steps 840, 860 and 870 to maintain an equilibrium between the spring and vacuum forces as the spring force is adjusted.

While particular elements, embodiments and applications of the presently described invention have been shown and described, it is understood that the presently described invention is not limited thereto since modifications may be made by those skilled in the technology, particularly in light of the foregoing teaching. It is therefore contemplated by the appended claims to cover such modifications and incorporate those features that come within the spirit and scope of the presently described invention.

The invention claimed is:

1. A vacuum pressure regulator including:

a spring encircling a knob and capable of being compressed when said knob is rotated in a first direction: and a housing including a chamber and a diaphragm, wherein a seal is formed when compression of said spring creates a spring force that pushes at least a portion of said diaphragm against a sealing surface of said chamber, said seal enabling said chamber to maintain a vacuum pressure in said chamber wherein said housing includes a post having a screw thread configured to engage with a screw thread of said knob so that rotating said knob in said first direction causes said knob to move along said post towards a distal end of said knob and rotating said knob in an opposite direction causes said knob to move along said post towards a proximal end of said knob.

2. The vacuum pressure regulator of claim 1, wherein said vacuum pressure pulls at least said portion of said diaphragm towards a proximal end of said regulator, said seal being compromised when said vacuum pressure is greater than said spring force.

3. The vacuum pressure regulator of claim 1, wherein said spring force can be increased by rotating said knob in said first direction and decreased by rotating said knob in a second direction.

4. The vacuum pressure regulator of claim 3, further including a tube surrounding a portion of said knob, wherein said knob includes a flange portion and said spring is compressed between said tube and said flange portion when said knob is rotated in said first direction.

5. The vacuum pressure regulator of claim 1, wherein said portion of said diaphragm includes a circular boss capable of being inserted into a center hole of a diaphragm coupling, said boss and said coupling forming a valve gate assembly.

6. The vacuum pressure regulator of claim 1, wherein said vacuum pressure is generated by an external vacuum pump, said vacuum pump generating said vacuum pressure via a tube connector attached to said housing and providing fluid communication with said chamber.

* * * * *

UNITED STATES PATENT AND TRADEMARK OFFICE

CERTIFICATE OF CORRECTION

PATENT NO. : 8,092,403 B2
APPLICATION NO. : 11/789149
DATED : January 10, 2012
INVENTOR(S) : Simon Siu Man Nan It is certified that error appears in the above-identified patent and that said Letters Patent is hereby corrected as shown below:

Col. 3, line 38: “turning knob” should read --turning knob 4--

Col. 4, line 39: “rum” should read --rim--

Col. 6, line 44: “flange.” should read --flange 45.--

Col. 6, line 63: “can clamped” should read --can be clamped--

Col. 7, line 47: “consequently lower” should read --consequently lowers--

Signed and Sealed this
Twenty-first Day of February, 2012

David J. Kappos

David J. Kappos
*Director of the United States Patent and Trademark Office*